United States Patent [19]

McNeil

[11] 4,242,821

[45] Jan. 6, 1981

[54] LIGHT BOX

[76] Inventor: John C. McNeil, 2 Glencairn St., Mulgrave, Victoria, Australia

[21] Appl. No.: 927,836

[22] Filed: Jul. 25, 1978

Related U.S. Application Data

[63] Continuation-in-part of Ser. No. 771,326, Feb. 23, 1977, abandoned.

[51] Int. Cl.[3] ..... G09F 13/04

[52] U.S. Cl. ..... 40/571; 40/572; 40/575; 40/611

[58] Field of Search ..... 40/549, 571, 572, 575, 40/574, 605, 611, 156, 152.2, 154, 578

[56] References Cited

U.S. PATENT DOCUMENTS

| | | | |
|---|---|---|---|
| 1,620,396 | 3/1927 | Sackett | 40/575 |
| 1,847,775 | 3/1932 | Manfre | 40/575 X |
| 1,879,147 | 9/1932 | Evans | 40/575 |
| 3,132,431 | 5/1964 | Petrie | 40/611 |
| 3,413,745 | 12/1968 | Cabe | 40/564 |
| 3,449,848 | 6/1969 | Howell | 40/605 |
| 4,021,949 | 5/1977 | Niehaus et al. | 40/361 |
| 4,067,130 | 1/1978 | Rasmussen | 40/152.2 |
| 4,117,533 | 9/1978 | Hagelthorn | 40/575 |

FOREIGN PATENT DOCUMENTS

| | | | |
|---|---|---|---|
| 402551 | 10/1909 | France | 40/575 |
| 1296472 | 11/1962 | France | 40/564 |

*Primary Examiner*—John F. Pitrelli
*Assistant Examiner*—G. Lee Skillington
*Attorney, Agent, or Firm*—Diller, Ramik & Wight

[57] ABSTRACT

The light box of the present invention comprises a peripheral wall which has opposite peripheral edges, a back wall adjacent one of those peripheral edges and a rigid one piece molded frame adjacent the other peripheral edge, the frame defining one side of the light box. The frame comprises front and rear faces and inner and outer side faces, gripping means comprised by a rearwardly opening channel on the frame which clampingly receives the aforementioned peripheral edge of the peripheral wall, that channel extending inwardly from the rear face towards the front face of the frame and being defined by a pair of opposed flanges each of which defines a respective one of the inner and outer side faces of the frame. The frame further includes a groove in the inner side face thereof which extends around the periphery and a slot in a portion of the frame extending therethrough between the inner and outer side faces, the groove and slot being substantially coplanar such that a marginal edge of a pictorial display can be held captive in the groove and is receivable therein through the slot. Illuminating means is mounted within the light box for illuminating the pictorial display.

12 Claims, 12 Drawing Figures

LIGHT BOX

Figure 1:
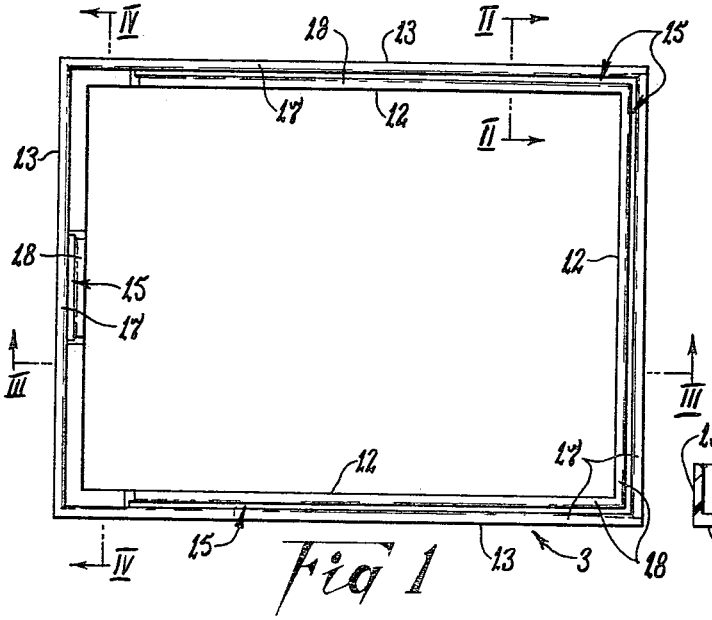

The present invention relates to a light box and particularly though not exclusively to light boxes serving as pictorial or advertising display units. This application is a continuation-in-part of pending U.S. application Ser. No. 771,326, filed Feb. 23, 1977, and now abandoned.

By "light box" in this specification is meant a box capable of containing one or more lamps and which is useful for display purposes, such a box having at least one transparent or translucent side which either constitutes or carries a picture, legend or other display.

Light boxes have, in the past, to the best of applicant's knowledge and belief, been manufactured in two basic forms. The first form consists of a metal box housing a fluorescent tube or similar light providing rear lighting of a print supported on a translucent panel of the box made of glass or a plastic material such as acrylic sheet. In the second form, the box is vacuum formed from plastic and may be in a number of shapes. Both of these forms are extremely expensive and consequently display light-boxes have not been used in any great quantity.

It is an object of the present invention to provide a light box which is simple in construction and relatively cheap to manufacture.

In one form, the light box of the present invention comprises a peripheral wall which has opposed peripheral edges, a back wall adjacent one of those peripheral edges and a rigid one piece molded frame adjacent the other peripheral edge the frame defining one side of the light box. The frame comprises front and rear faces and inner and outer side faces, gripping means comprised by a rearwardly opening channel on the frame which clampingly receives the aforementioned peripheral edge of the peripheral wall that channel extending inwardly from the rear face towards the front face of the frame and being defined by a pair of opposed flanges each of which defines a respective one of the inner and outer side faces of the frame. The frame further includes a groove in the inner side face thereof which extends around the periphery and a slot in a portion of the frame extending therethrough between the inner and outer side faces, the groove and slot being substantially coplanar such that a marginal edge of a pictorial display can be held captive in the groove and is receivable therein through the slot. Illuminating means is mounted within the light box for illuminating the pictorial display.

In another form of the invention there is provided a light box similar to that described above, except that the back wall of the box section is replaced by an additional one piece molded frame as described above. Thus, in this particular embodiment two pictorial displays are mountable within the one light box.

According to a further embodiment of the present invention a light box comprises top and bottom walls each having a peripheral edge and a plurality of rigid one piece molded frames each of which defines a respective side of the light box. These frames are essentially the same as those described above and include front and rear faces and inner and outer side faces and gripping means comprised by a rearwardly opening channel for clampingly receiving a respective portion of the peripheral edges of the top and bottom walls.

Preferably, the frames are substantially rectangular in shape so as to define four side sections and the flange of the channel which defines the aforementioned inner face of the frame is discontinuous around the periphery of the frame. Desirably, the discontinuous flange extends substantially around three of the aforementioned side sections of the frame terminating short of the fourth side section. The fourth side section is provided with a small length of the discontinuous flange intermediate its ends.

The light box may further include a light mounting for mounting the illuminating means on to the light box. In one form, the light mounting is constructed from a blank which comprises a central portion defining an aperture therein four side flanges extending from a respective side of the central portion and being bendable about fold lines at each said side so as to define a frusto-pyramidally shaped structure. In this arrangement, the side flanges define side walls and the central portion defines a mounting wall for the illuminating means. The blank further includes a bar to secure flanges which extend from opposed side flanges each securing flange having a locking tab and the free end thereof, said securing flaps being adapted to extend through associated flaps through a wall of the light box, said locking tabs being associated within said secondary slots in said wall so as to secure the frusto-pyramidally shaped structure thereto.

The essential features of the invention, and further optional features, are described in detail in the following passages of the specification which refer to the accompanying drawings. The drawings however, are merely illustrative of how the invention might be put into effect, so that the specific form and arrangement of the features (whether they be essential or optional features) shown is not to be understood as limiting on the invention.

Figure 2:
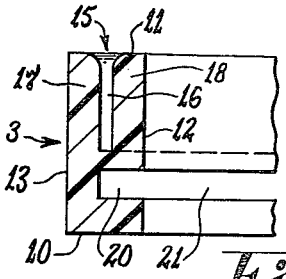
Figure 4:
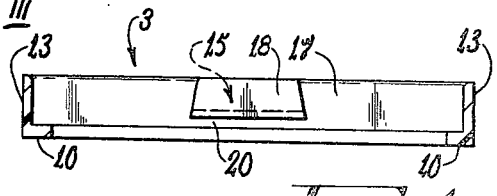
Figure 3:
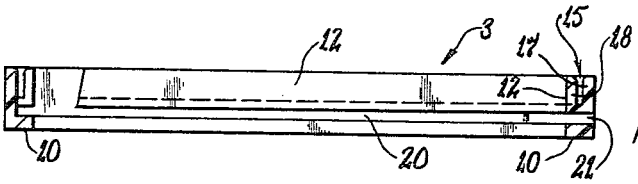
Figure 5:
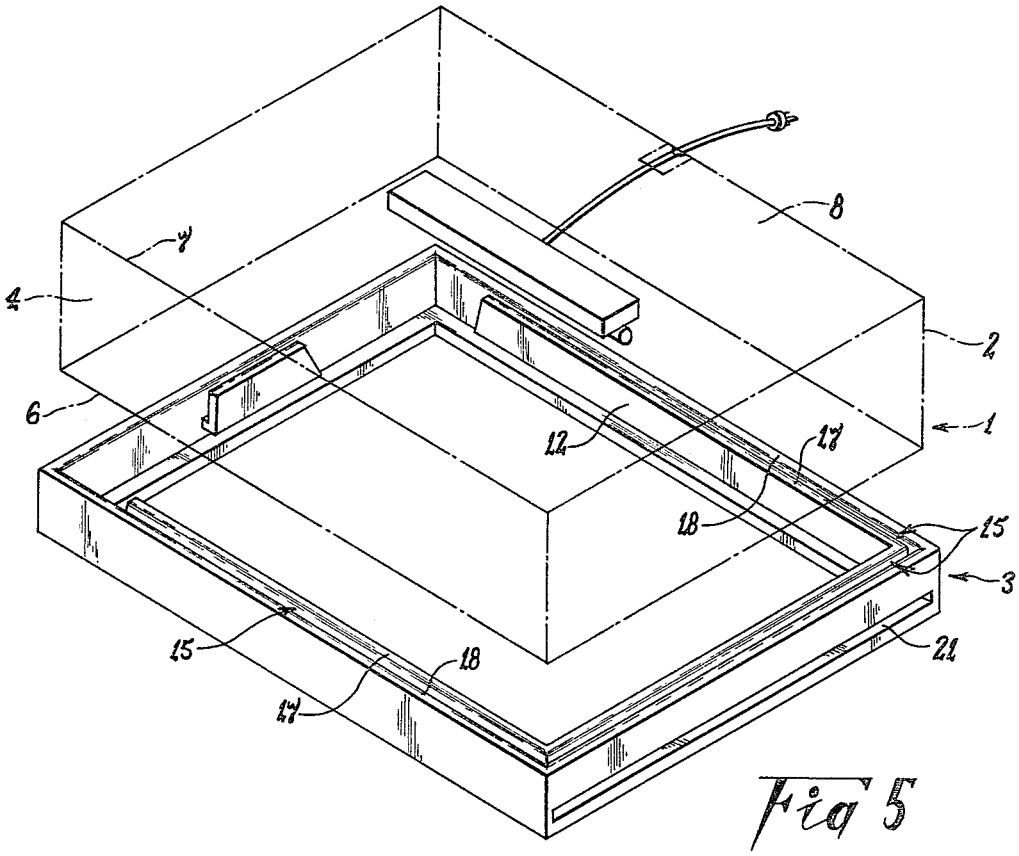
Figure 6:
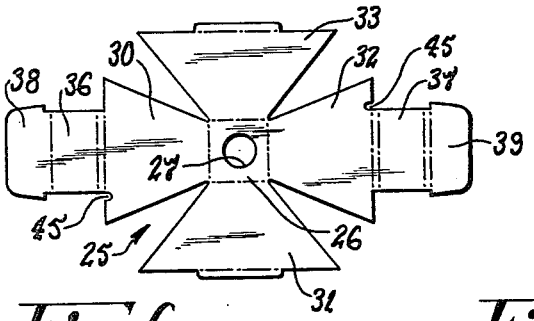
Figure 7:
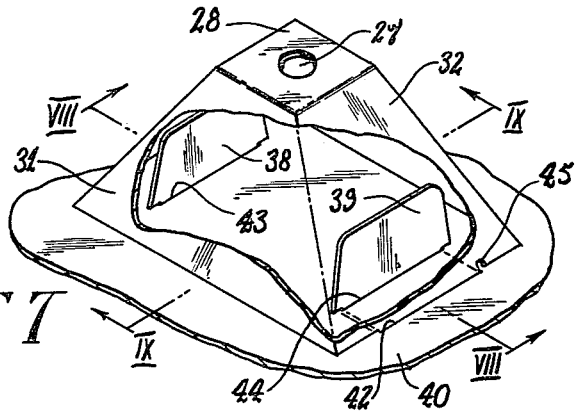
Figure 8:
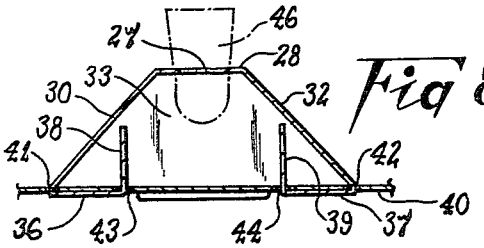
Figure 9:
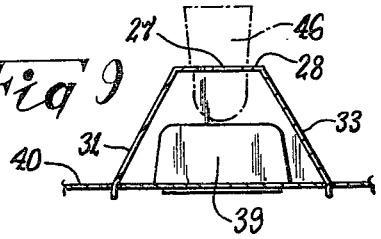

In the drawings:

FIG. 1 is a plan view of a frame for use in a light box according to the invention, FIG. 2 is a sectional elevation of the frame taken along the line II—II in FIG. 1, FIG. 3 is a sectional elevation of the frame taken along the line III—III in FIG. 1, FIG. 4 is a sectional elevation of the frame taken along the line IV—IV in FIG. 1, FIG. 5 is a perspective view of one form of light box according to the invention, FIG. 6 is a plan view of a blank used in the construction of a light mounting for the light box, FIG. 7 is a perspective view of the light mounting formed from the blank shown in FIG. 6, FIG. 8 is a sectional elevation of the light mounting taken along the line VII—VII in FIG. 7, FIG. 9 is a sectional elevation of the light mounting taken along the line IX—IX in FIG. 7, FIGS. 10 to 12 are perspective views of alternate embodiments of light boxes in accordance with the invention.

Referring to FIG. 5 in conjunction with FIGS. 1 to 4 one form of light box generally indicated at 1 is shown. The light box includes a box section 2 (shown in phantom) and a frame 3. The box section 2 includes a peripheral sidewall 4 having peripheral edges 6 and 7 and a backwall 8 which is adjacent one of the sidewall edges 7. The frame 3 is located adjacent the other sidewall edge 6. The box section 2 may be constructed in any suitable manner. For example, the peripheral wall 4 and backwall 8 may be of either integral or separate construction. Any suitable material may be used in the construction of the box section such as wood, metal or plastics. In a preferred form plastics material known as POLYFLUTE or CORFLUTE is used.

It is believed that POLYFLUTE is the British trade name for a material known in Australia as CORFLUTE. It consists of two flat sheets of translucent plastics material separated by and bonded to an intermediate corrugated sheet of plastics material. Thus, the material POLYFLUTE can be regarded as the plastics equivalent of corrugated board, but unlike corrugated board, it allows light to pass through it. It can be obtained in various colours.

The frame 3 of the light box 1 is shown in detail in FIGS. 1 to 4 and includes a front face 10, rear face 11 and inner and outer side faces 12 and 13 respectively. An important feature of the invention is that the frame is a rigid one piece molding which provides a rigid structure not only for mounting a pictorial display but also provides the light box as a whole with its rigidity. A further advantage of the frame 3 being a one piece molding is that it can be manufactured extremely cheaply and efficiently. Any suitable molding technique may be used such as casting, pressure molding, injection molding and the like however, preferably, the frame is manufactured by injection molding. Desirably, the frame is constructed from plastics material such as PVC, ABS or the like.

The frame 3 further includes gripping means 15 in the form of a channel 16 which is defined by flanges 17 and 18. The channel 16 opens rearwardly and extends towards the front face 10 of the frame. The outer flange 17 is an extension of outer side face 13 and the inner flange 18 defines inner side face 12 of the frame. The channel 16 is arranged to clampingly receive peripheral edge 6 of box section 2 therein so as to hold the two components together. As shown in the drawings, the inner flange 18 extends around a substantial portion of the periphery of the frame 3 but is discontinuous along one section thereof. This discontinuity enables the frame 3 to be conveniently constructed as a one piece molding.

The frame 3 can take any suitable shape and as shown in the drawings it is rectangular. It is desirable that in the form of lightbox shown in FIG. 5 the box section 2 be gripped along each linear section of its peripheral edge 6. Thus, the inner flange 18 although discontinuous around the periphery of the frame has a section along each linear portion of the frame.

A groove 20 is further provided on the inner side face of the frame 3, the purpose of this groove being to receive and hold captive therein the marginal edge of a pictorial display. Preferably, groove 20 is located between channel 16 and the front face 10 of frame 3 and extends substantially around the perimeter thereof. It will be appreciated however, that groove 20 could be positioned elsewhere such as for example in the inner face of inner flange 18. A slot 21 is provided for enabling access of a pictorial display to groove 20. The slot 21 extends through the frame 3 between the inner and outer side faces 12 and 13 and is substantially coplanar with groove 20.

The lightbox 1 further includes illuminating means mounted within the box for illuminating the pictorial display. The illuminating means may be in the form of an electric fluorescent light as shown in FIG. 5 or an ordinary light globe 46 as shown partially in phantom in FIGS. 8 and 9. One form of light mounting which is particularly advantageous for the present invention is shown in FIGS. 6 to 9. This form of light mounting is particularly advantageous since the position of the light within the box can be readily changed.

Referring to FIGS. 6 to 9 the light mounting is formed from a blank 25 (FIG. 6) which preferably is constructed from the CORFLUTE material referred to earlier. The blank 25 comprises a central portion 26 having an aperture 27 therein which when in its formed configuration defines a light mounting wall 28. The blank 25 further includes four side flaps 30, 31, 32, and 33 each extending from a respective side of the central portion and bendable about fold lines at the periphery of the central portion so as to define side walls. The blank 25 is shaped so that when folded as described above, it forms a mounting which is in the shape of a frusto-pyramid as is indicated in FIGS. 7 to 9. The blank further includes a pair of securing flaps 36 and 37 these flaps extending from opposed side flaps 30 and 32. Each securing flap 30 and 32 further includes a locking tab 38 and 39 at the free end thereof for reasons which will become hereinafter apparent.

The light mounting is secured to a wall of the light box by means of securing flaps 36 and 37 and their associated locking tabs 38 and 39. The securing flaps 36 and 37 extend through associated slots 41 and 42 in the wall of the light box (item 40 in FIGS. 7 to 9) and are folded over so that the base of the sidewalls are held firmly against the light box wall 40. The locking tabs 38 and 39 are subsequently passed through respective secondary slots 43 and 44 in lightbox wall 40 to restrain the securing flaps from pulling out of their associated slots 41 and 42. A bulb (not shown) may be mounted within aperture 27 and its associated cord pass through notch 45 to an appropriate power source.

Figure 10:
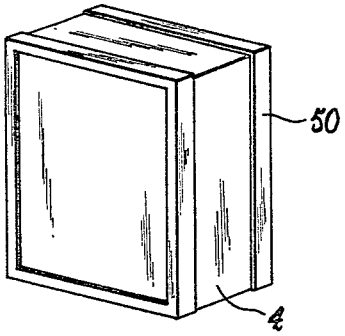
Figure 11:
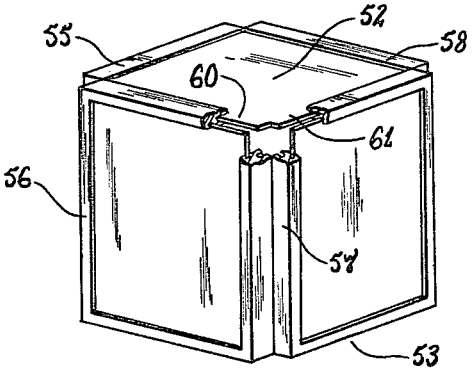
Figure 12:
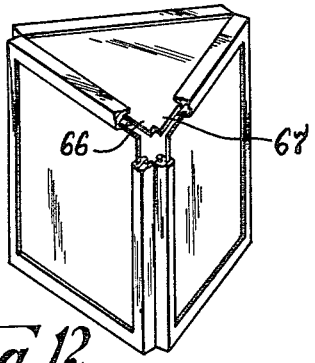

The light box of the invention has so far been described with reference to the form shown in FIG. 5. Other forms of light boxes constructed in accordance with the invention are shown in FIGS. 10 to 12. In these three forms of the invention a plurality of frames are used these frames desireably being of the same construction of the frame described with reference to FIGS. 1 to 4.

Referring to FIG. 10 of the drawings this form of light box is basically the same as that shown in FIG. 5 except that a second frame (indicated at 50) is substituted for the backwall. Thus, two pictorial displays may be mounted in the single lightbox. The light mounting may be attached to a suitable section of the peripheral wall 4.

FIG. 11 shows a light box which is adapted to be received for pictorial displays. In this form of the invention the lightbox comprises a top wall 52 a bottom wall 53 and four frames 55, 56, 57 and 58 of the type previously described. The sidewalls of the top and bottom wall have mounting portions 60 and 61 around the peripheral edge of each wall which are receivable within a respective channel of each frame. The light mounting may be attached to either the top or bottom wall.

FIG. 12 shows a light box similar to that of FIG. 11 except that the top and bottom walls 66 and 67 are triangular in shape rather than rectangular.

It will be readily appreciated from the foregoing that the light box of the present invention provides for simple and cheap manufacture as well as an adaptability heretofor unknown in this particular art.

Finally it is to be understood that various alterations, modifications and/or additions may be introduced into the constructions and arrangements of parts previously described without departing from the spirit or ambit of the invention as defined by the following claims.

Having now described my invention, what I claim as new and desire to secure by Letters Patent is:

1. A light box comprising:
(a) a peripheral wall having opposite peripheral edges;
(b) a backwall adjacent one of said peripheral edges;
(c) a rigid one piece molded frame adjacent the other of said peripheral edges, said frame defining one side of the light box, said frame comprising;
(i) front and rear faces and inner and outer side faces;
(ii) gripping means including a rearwardly opening channel on said frame clampingly receiving the other said peripheral edge of said peripheral wall, said channel extending inwardly from said rear face towards said front face, said channel being defined by a pair of opposed flanges each of which defines a respective one of said inner and outer side faces;
(iii) a groove in the inner side face of said frame and extending around the periphery thereof;
(iv) a slot in a portion of said frame extending therethrough between the inner and outer side faces, said groove and said slot being substantially co-planar whereby a marginal edge of a pictorial display is held captive in said groove and is receivable therein through said slot; and
(d) illuminating means mounted within the lightbox for illuminating the pictorial display.

2. A light box according to claim 1 wherein said frame is substantially rectangular in shape so as to define four side sections, and said flange of said channel which defines said inner face of said frame being discontinuous around the periphery of said frame.

3. A light box according to claim 2, wherein said discontinuous flange extends substantially around three of said side sections terminating short of said fourth side section, and said fourth side section having a small length of said discontinuous flange intermediate its ends.

4. A light box according to claim 1 further including a light mounting for mounting said illuminating means on to the light box, said light mounting being constructed from a blank which comprises a central portion having an aperture therein, four side flanges extending from a respective side of the central portion and being bendable about fold lines at each said side of said central portion so as to define a frusto-pyramidally shaped structure, said side flanges defining side walls and said central portion defining a mounting wall for said illuminating means which is mounted thereon by said aperture, said blank further including a pair of securing flaps which extend from opposed side flanges, each securing flap having a locking tab at the free end thereof, said securing flaps being adapted to extend through associated slots in a wall of the light box, said locking tabs being receivable within associated secondary slots so as to secure the frusto-pyramidally shaped structure to said wall.

5. A light box comprising:
(a) a peripheral wall having opposite peripheral edges;
(b) two rigid one piece molded frames each adjacent a respective one of said peripheral edges and each defining a side of the light box, each of said frames comprising:
(i) front and rear faces and inner and outer side faces;
(ii) gripping means including a rearwardly opening channel on each of said frames clampingly receiving a respective peripheral edge of said peripheral wall, said channel extending inwardly from said rear face towards said front face, said channel being defined by a pair of opposed flanges each of which defines a respective one of said inner and outer side faces;
(iii) a groove in the inner side face of each of said frames and extending around the periphery thereof;
(iv) a slot in a portion of each of said frames extending therethrough between the inner and outer side faces, said groove and said slot being substantially co-planar whereby a marginal edge of a pictorial display is held captive in said groove and is locatable therein through said slot; and
(c) illuminating means mounted within the lightbox for illuminating the pictorial displays.

6. A light box according to claim 5 wherein each of said frames is substantially rectangular in shape so as to define four side sections, and said flange of said channel which defines said inner face of each of said frames being discontinuous around the periphery of each of said frames.

7. A light box according to claim 6 wherein said discontinuous flange extends substantially around three of said side sections terminating short of said fourth side section, and said fourth side section having a small length of said discontinuous flange intermediate its ends.

8. A light box according to claim 5, further including a light mounting for mounting said illuminating means on to the light box, said light mounting being constructed from a blank which comprises a central portion having an aperture therein, four side flanges extending from a respective side of the central portion and being bendable about fold lines at each said side of said central portion so as to define a frusto-pyramidally shaped structure, said side flanges defining side walls and said central portion defining a mounting wall for said illuminating means which is mounted thereon by said aperture, said blank further including a pair of securing flaps which extend from opposed side flanges, each securing flap having a locking tab at the free end thereof, said securing flaps being adapted to extend through associated slots in a wall of the light box, said locking tabs being receivable within associated secondary slots so as to secure the frusto-pyramidally shaped structure to said wall.

9. A light box comprising:
(a) top and bottom walls each having a peripheral edge;
(b) a plurality of rigid one piece molded frames, each frame defining a respective side of said light box and comprising;
(i) front and rear faces and inner and outer side faces;
(ii) gripping means including a rearwardly opening channel clampingly receiving a respective portion of the peripheral edge of each of said top and bottom walls to secure said walls in spaced relationship, said channel extending inwardly from said rear face towards said front face, said channel being defined by a pair of opposed said inner and outer side faces;

(iii) a groove in the inner side face of said frame and extending around the periphery thereof;

(iv) a slot in a portion of each said frame extending therethrough between the inner and outer side faces, said groove and said slot being substantially co-planar whereby a marginal edge of a pictorial display is held captive in said groove and is locatable therein through said slot; and (d) illuminating means mounted within the lightbox for illuminating the pictorial displays.

10. A light box according to claim 9 wherein said frame is substantially rectangular in shape so as to define four side sections, and said flange of said channel which defines said inner face of said frame being discontinuous around the periphery of said frame.

11. A light box according to claim 10 wherein said discontinuous flange extends substantially around three of said side sections terminating short of said fourth side section, and said fourth side section having a small length of said discontinuous flange intermediate its ends.

12. A light box according to claim 9 further including a light mounting for mounting said illuminating means on to the light box, said light mounting being constructed from a blank which comprises a central portion having an aperture therein, four side flanges extending from a respective side of the central portion and being bendable about fold lines at each said side of said central portion so as to define a frusto-pyramidally shaped structure, said side flanges defining side walls and said central portion defining a mounting wall for said illuminating means which is mounted thereon by said aperture, said blank further including a pair of securing flaps which extend from opposed side flanges, each securing flap having a locking tab at the free end thereof, said securing flaps being adapted to extend through associated slots in a wall of the light box, said locking tabs being receivable within associated secondary slots so as to secure the frusto-pyramidally shaped structure to said wall.

* * * * *